US011131163B2

(12) United States Patent
Lee et al.

(10) Patent No.: US 11,131,163 B2
(45) Date of Patent: Sep. 28, 2021

(54) SYSTEMS AND METHODS FOR SEALING A WELLBORE

(71) Applicant: G&H Diversified Manufacturing LP, Houston, TX (US)

(72) Inventors: Timmothy Alain Lee, Tomball, TX (US); Joshua Magill, Cypress, TX (US)

(73) Assignee: G&H Diversified Manufacturing LP, Houston, TX (US)

( * ) Notice: Subject to any disclaimer, the term of this patent is extended or adjusted under 35 U.S.C. 154(b) by 195 days.

(21) Appl. No.: 16/152,184

(22) Filed: Oct. 4, 2018

(65) Prior Publication Data

US 2019/0106962 A1 Apr. 11, 2019

Related U.S. Application Data

(60) Provisional application No. 62/734,803, filed on Sep. 21, 2018, provisional application No. 62/569,447, filed on Oct. 6, 2017.

(51) Int. Cl.

| | |
|---|---|
| ***E21B 33/129*** | (2006.01) |
| ***E21B 23/06*** | (2006.01) |
| ***E21B 33/128*** | (2006.01) |
| ***E21B 43/26*** | (2006.01) |

(52) U.S. Cl.

CPC ..... *E21B 33/1293* (2013.01); *E21B 23/06* (2013.01); *E21B 33/128* (2013.01); *E21B 43/26* (2013.01)

(58) Field of Classification Search

CPC ..... E21B 43/26; E21B 23/06; E21B 33/128; E21B 33/1293; E21B 33/1291; E21B 33/1292; E21B 33/134

See application file for complete search history.

(56) References Cited

U.S. PATENT DOCUMENTS

| | | | | |
|---|---|---|---|---|
| 2,196,656 A * | 4/1940 | Burt | E21B 33/134 | 166/223 |
| 2,230,712 A * | 2/1941 | Bendeler | E21B 33/128 | 166/123 |
| 3,221,818 A * | 12/1965 | Bostock | E21B 33/1285 | 277/338 |
| 3,422,902 A * | 1/1969 | Bouchillon | E21B 33/126 | 166/202 |
| 3,602,305 A * | 8/1971 | Kisling, III | E21B 23/06 | 166/134 |
| 3,670,815 A * | 6/1972 | Brown | E21B 33/129 | 166/136 |
| 4,378,838 A * | 4/1983 | Ogden | E21B 33/16 | 166/153 |

(Continued)

FOREIGN PATENT DOCUMENTS

| | | | |
|---|---|---|---|
| WO | WO-2014077800 A1 * | 5/2014 | E21B 23/06 |
| WO | WO-2019071024 A1 * | 4/2019 | E21B 33/1293 |

*Primary Examiner* — Jennifer H Gay

(74) *Attorney, Agent, or Firm* — Conley Rose, P.C.

(57) ABSTRACT

A plug for sealing a wellbore includes a slip assembly including a plurality of arcuate slip segments, a nose cone coupled to the slip assembly and including a first end and a second end opposite the first end, wherein at least one of the slip assembly and the nose cone includes a plurality of circumferentially spaced pockets, and wherein at least one of the slip assembly and the nose cone includes a plurality of circumferentially spaced protrusions configured to be received in the pockets.

21 Claims, 14 Drawing Sheets

(56) References Cited

U.S. PATENT DOCUMENTS 4,393,929 A * 7/1983 Akkerman ..... E21B 33/1295 166/120
4,397,351 A * 8/1983 Harris ..... E21B 33/1293 166/134
4,440,223 A * 4/1984 Akkerman ..... E21B 33/1295 166/134
7,735,549 B1 * 6/2010 Nish ..... E21B 33/134 166/134
8,579,023 B1 * 11/2013 Nish ..... E21B 33/128 166/118
8,770,276 B1 * 7/2014 Nish ..... E21B 33/1291 166/118
9,045,963 B2 * 6/2015 Shkurti ..... E21B 33/1285
9,334,703 B2 * 5/2016 VanLue ..... E21B 33/134
9,739,106 B2 * 8/2017 Tse ..... E21B 23/06
9,777,551 B2 * 10/2017 Davies ..... E21B 33/128
10,036,221 B2 * 7/2018 Davies ..... E21B 33/1291
10,246,967 B2 * 4/2019 Davies ..... E21B 33/128
10,316,617 B2 * 6/2019 Davies ..... E21B 33/1291
10,385,651 B2 * 8/2019 Smith ..... E21B 33/1293
10,605,044 B2 * 3/2020 Davies ..... E21B 33/134
2007/0227745 A1 * 10/2007 Roberts ..... E21B 33/134 166/386
2008/0001111 A1 * 1/2008 Ross ..... E21B 23/04 251/230
2008/0202771 A1 * 8/2008 Carisella ..... E21B 33/1216 166/387
2010/0263876 A1 * 10/2010 Frazier ..... E21B 33/129 166/378
2011/0259610 A1 * 10/2011 Shkurti ..... E21B 33/12 166/386
2013/0240201 A1 * 9/2013 Frazier ..... E21B 33/134 166/135
2013/0341049 A1 * 12/2013 Roberts ..... E21B 23/01 166/382
2014/0020911 A1 * 1/2014 Martinez ..... E21B 23/01 166/387
2015/0101796 A1 * 4/2015 Davies ..... E21B 34/14 166/192
2015/0101797 A1 * 4/2015 Davies ..... E21B 33/1208 166/193
2015/0308217 A1 * 10/2015 VanLue ..... E21B 23/06 166/135
2015/0308250 A1 * 10/2015 Anders ..... E21B 43/164 166/308.2
2016/0123100 A1 * 5/2016 Tse ..... E21B 33/1216 166/387
2016/0145957 A1 * 5/2016 Davies ..... E21B 33/1216 166/382
2016/0237776 A1 * 8/2016 VanLue ..... E21B 34/16
2016/0265305 A1 * 9/2016 Davies ..... E21B 33/134
2017/0101835 A1 * 4/2017 Webster ..... E21B 33/134
2017/0101836 A1 * 4/2017 Webster ..... E21B 33/134
2017/0122049 A1 * 5/2017 Davies ..... E21B 33/128
2017/0260823 A1 * 9/2017 Roseman ..... E21B 33/128
2017/0314361 A1 * 11/2017 Rosenthal ..... E21B 33/134
2018/0045014 A1 * 2/2018 Larisey ..... E21B 33/12
2018/0179851 A1 * 6/2018 Davies ..... E21B 23/01
2018/0291703 A1 * 10/2018 Vanlue ..... E21B 23/01
2018/0305997 A1 * 10/2018 Chen ..... E21B 33/1208
2018/0363410 A1 * 12/2018 Dey ..... E21B 23/00
2019/0106962 A1 * 4/2019 Lee ..... E21B 23/06
2019/0162044 A1 * 5/2019 Dirocco ..... E21B 33/1294
2019/0234177 A1 * 8/2019 Silva ..... E21B 33/1204
2019/0264513 A1 * 8/2019 Kosel ..... E21B 19/07

* cited by examiner

SYSTEMS AND METHODS FOR SEALING A WELLBORE

CROSS-REFERENCE TO RELATED APPLICATIONS

This application claims benefit of U.S. provisional patent application Ser. No. 62/569,447 filed Oct. 6, 2017, and entitled "Downhole Plug," and U.S. provisional patent application Ser. No. 62/734,803 filed Sep. 21, 2018, and entitled "Downhole Plug," each of which is hereby incorporated herein by reference in its entirety.

STATEMENT REGARDING FEDERALLY SPONSORED RESEARCH OR DEVELOPMENT

Not applicable.

BACKGROUND

After a wellbore has been drilled through a subterranean formation, the wellbore may be cased by inserting lengths of pipe ("casing sections") connected end-to-end into the wellbore. Threaded exterior connectors known as casing collars may be used to connect adjacent ends of the casing sections at casing joints, providing a casing string including casing sections and connecting casing collars that extends from the surface towards the bottom of the wellbore. The casing string may then be cemented into place to secure the casing string within the wellbore.

In some applications, following the casing of the wellbore, a wireline tool string may be run into the wellbore as part of a "plug-n-perf" hydraulic fracturing operation. The wireline tool string may include a perforating gun for perforating the casing string at a desired location in the wellbore, a downhole plug that may be set to couple with the casing string at a desired location in the wellbore, and a setting tool for setting the downhole plug. In certain applications, once the casing string has been perforated by the perforating gun and the downhole plug has been set, a ball or dart may be pumped into the wellbore for landing against the set downhole plug, thereby isolating the portion of the wellbore extending uphole from the set downhole plug. With this uphole portion of the wellbore isolated, the formation extending about the perforated section of the casing string may be hydraulically fractured by fracturing fluid pumped into the wellbore.

SUMMARY OF THE DISCLOSURE

An embodiment for a plug for sealing a wellbore comprises a slip assembly comprising a plurality of arcuate slip segments, and a nose cone coupled to the slip assembly and comprising a first end and a second end opposite the first end, wherein at least one of the slip assembly and the nose cone comprises a plurality of circumferentially spaced pockets, wherein at least one of the slip assembly and the nose cone comprises a plurality of circumferentially spaced protrusions configured to be received in the pockets. In some embodiments, the slip assembly comprises the pockets, at least one pocket extending into an inner surface of each slip segment of the slip assembly, and the nose cone comprises the protrusions, the protrusions extending from the first end of the nose cone. In some embodiments, the plug further comprises a mandrel comprising a central passage, and a packer disposed about the mandrel, the packer configured to seal the wellbore in response to the plug being actuated from a first position to a second position, wherein at least one of the mandrel and the nose cone comprise an arcuate recess, wherein at least one of the mandrel and the nose cone comprises an arcuate protrusion. In certain embodiments, the mandrel comprises the arcuate recess, the arcuate recess extending into an end of the mandrel, and the nose cone comprises the arcuate protrusion, the arcuate protrusion extending from the second end of the nose cone. In certain embodiments, the plug further comprises an engagement disk disposed about the mandrel, a first clamping member disposed about the mandrel, wherein at least one of the engagement disk and the first clamping member comprises a recess and wherein at least one of the engagement disk and first clamping member comprises a protrusion configured to be received in the recess to restrict relative rotation between the engagement disk and the first clamping member. In some embodiments, the engagement disk comprises the protrusion, the protrusion extending from an end of the engagement disk, and the first clamping member comprises the recess, the recess extending into an end of the first clamping member, wherein the protrusion of the engagement disk and the recess of the first clamping member are each hexagonal. In some embodiments, the plug further comprises a second clamping member disposed about the mandrel, wherein the first and second clamping members each apply a compressive force to the packer in response to the plug being actuated from a first position to a second position, a slip assembly disposed about the mandrel and comprising a plurality of arcuate slip segments, wherein the slip segments are configured to affix the plug to a string disposed in the wellbore, wherein the second clamping member comprises an outer surface including a plurality of circumferentially spaced planar surfaces, wherein each slip segment of the slip assembly comprises a planar inner surface in engagement with one of the planar surfaces of the second clamping member. In some embodiments, the mandrel comprises a first end, a second end opposite the first end, and an outer surface extending between the first end and the second end, the outer surface of the mandrel comprises a plurality of circumferentially spaced recesses, and a plurality of arcuate inserts are received in the plurality of circumferentially spaced recesses of the mandrel.

An embodiment for a plug for sealing a wellbore comprises a mandrel comprising a central passage, a packer disposed about the mandrel, the packer configured to seal the wellbore in response to the plug being actuated from a first position to a second position, and a nose cone coupled to the mandrel, wherein the nose cone comprises an inner surface including a molded protrusion extending therefrom, wherein the molded protrusion is configured to prevent a spherical ball from sealing against the inner surface of the nose cone. In some embodiments, the nose cone is molded from a nonmetallic material. In some embodiments, the plug further comprises an engagement disk disposed about the mandrel and comprising a protrusion extending from an end of the engagement disk, a first clamping member disposed about the mandrel and comprising a recess extending into an end thereof, wherein the recess is configured to receive the protrusion of the engagement disk to restrict relative rotation between the engagement disk and the first clamping member. In certain embodiments, both the engagement disk and the first clamping member are molded from a nonmetallic material.

An embodiment of a plug for sealing a wellbore comprises a mandrel comprising a central passage, a packer disposed about the mandrel, the packer configured to seal the wellbore in response to the plug being actuated from a first position to a second position, and a nose cone coupled to the mandrel, wherein the nose cone comprises an outer surface including an annular fin configured to provide a turbulent fluid flow in response to a fluid flow in the wellbore flowing around the plug. In some embodiments, the fin is configured to increase the surface area of the outer surface of the nose cone. In some embodiments, the plug further comprises an engagement disk disposed about the mandrel and comprising a protrusion extending from an end of the engagement disk, a first clamping member disposed about the mandrel and comprising a recess extending into an end thereof, wherein the recess is configured to receive the protrusion of the engagement disk to restrict relative rotation between the engagement disk and the first clamping member. In some embodiments, the plug further comprises a second clamping member disposed about the mandrel, wherein the first and second clamping members each apply a compressive force to the packer in response to the plug being actuated from a first position to a second position, a slip assembly disposed about the mandrel and comprising a plurality of arcuate slip segments, wherein the slip segments are configured to affix the plug to a string disposed in the wellbore.

An embodiment of a plug for sealing a wellbore comprises a mandrel comprising an outer surface including a plurality of ratchet teeth, and a body lock ring assembly comprising a plurality of arcuate lock ring segments, wherein an inner surface of each lock ring segment comprises a plurality of ratchet teeth configured to matingly engage the ratchet teeth of the mandrel, wherein the body lock ring is configured to lock the plug in sealing engagement with an inner surface of a tubular member disposed in the wellbore. In some embodiments, the plug further comprises a packer disposed about the mandrel, and a first clamping member disposed about the mandrel and configured to apply a clamping force against the packer, wherein each arcuate lock ring segment comprises a frustoconical outer surface configured to engage a frustoconical inner surface of the first clamping member. In some embodiments, the plug further comprises an annular lock ring retainer, wherein the lock ring retainer is received in a groove formed in each of the arcuate lock ring segments. In certain embodiments, the outer surface of the mandrel comprises a plurality of circumferentially spaced recesses, a plurality of arcuate inserts are received in the plurality of circumferentially spaced recesses of the mandrel, and wherein each arcuate insert comprises an outer surface including a plurality of ratchet teeth configured to matingly engage the ratchet teeth of the arcuate ring segments of the body lock ring, wherein the mandrel comprises a first material having a first shear strength, the plurality of arcuate inserts each comprises a second material having a second shear strength, and the second shear strength is greater than the first shear strength.

BRIEF DESCRIPTION OF THE DRAWINGS

For a detailed description of exemplary embodiments of the disclosure, reference will now be made to the accompanying drawings in which.

DETAILED DESCRIPTION

Figure 1:
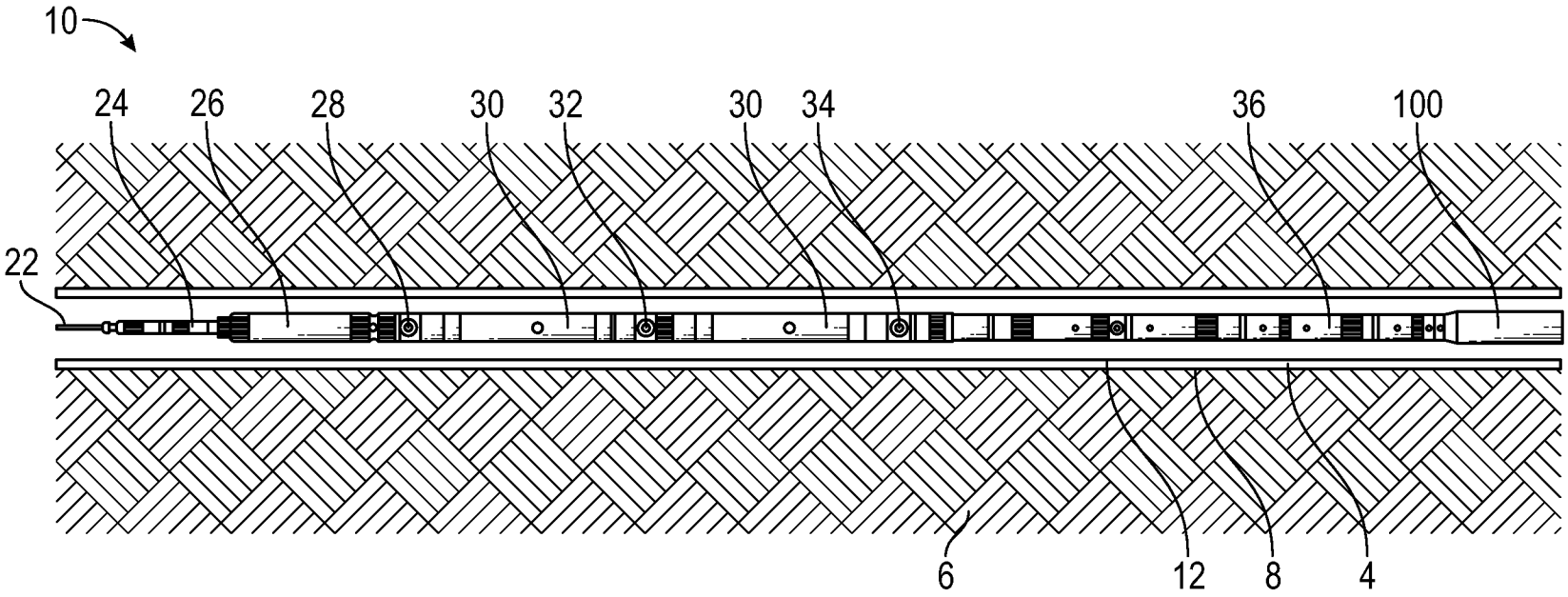
FIG. 1 is a schematic, partial cross-sectional view of a system for completing a subterranean well including an embodiment of a downhole plug in accordance with the principles disclosed herein.
Figure 2:
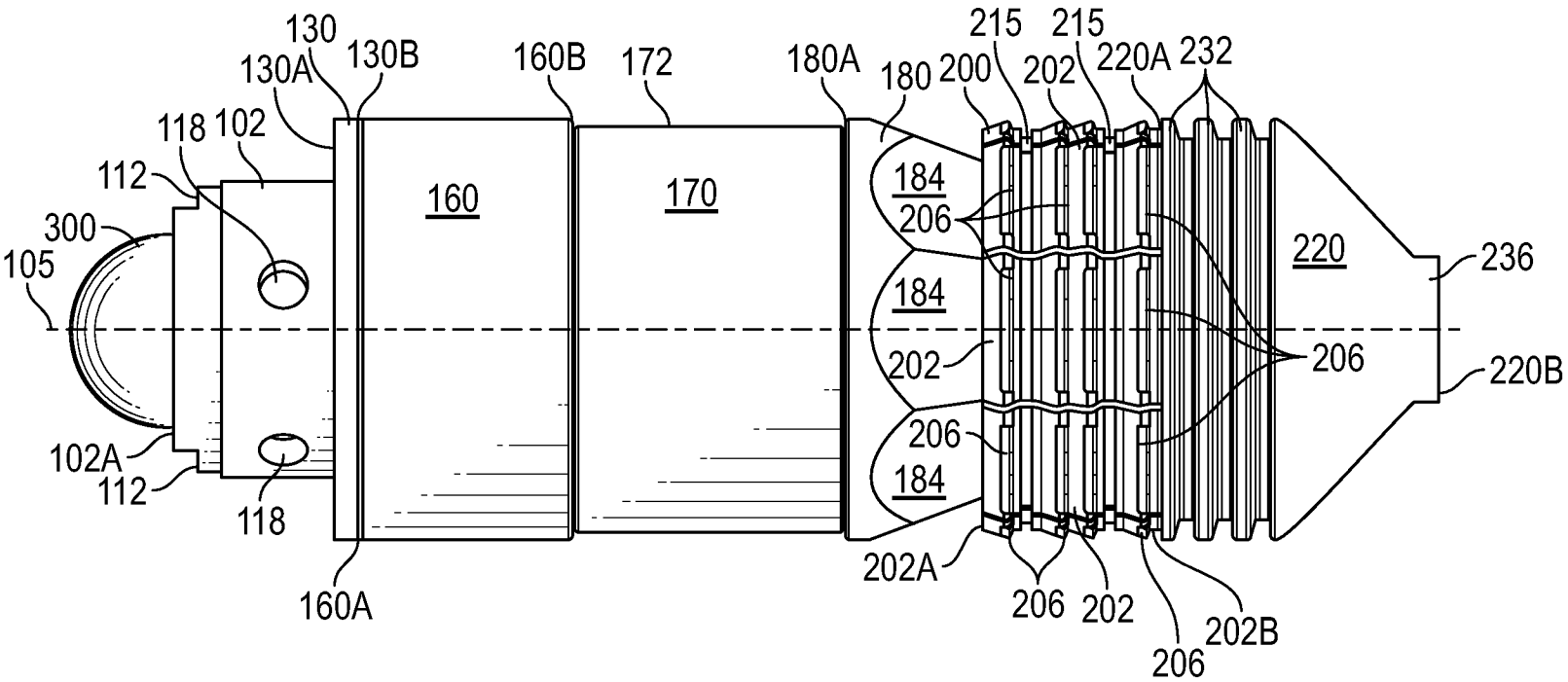
FIG. 2 is a side view of the downhole plug of FIG. 1.
Figure 3:
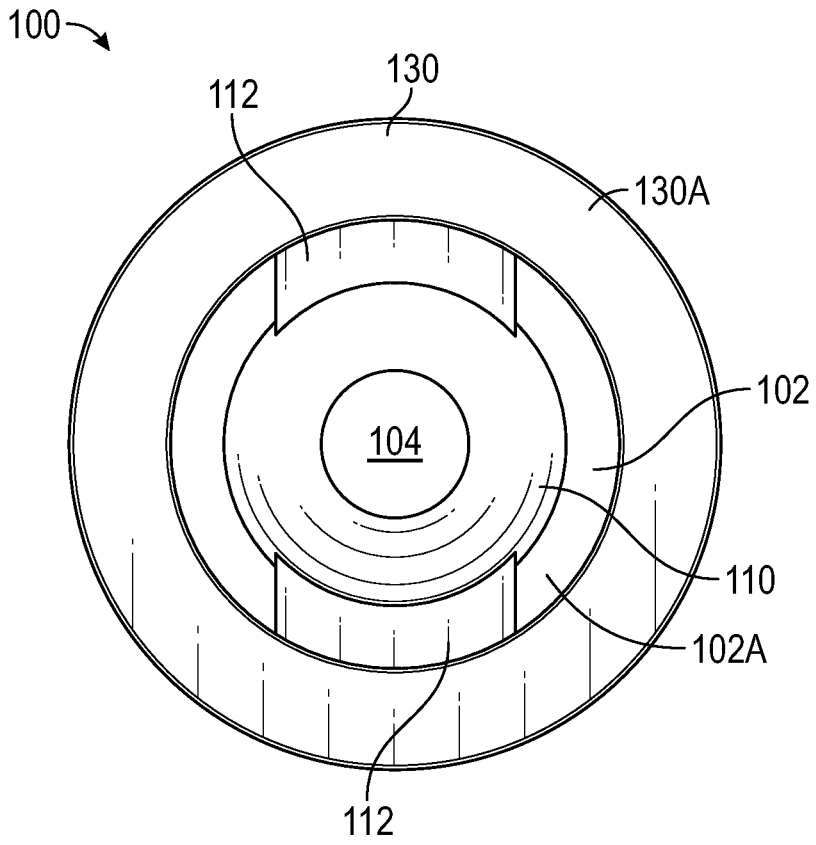
FIG. 3 is a front view of the downhole plug of FIG. 1.
Figure 4:
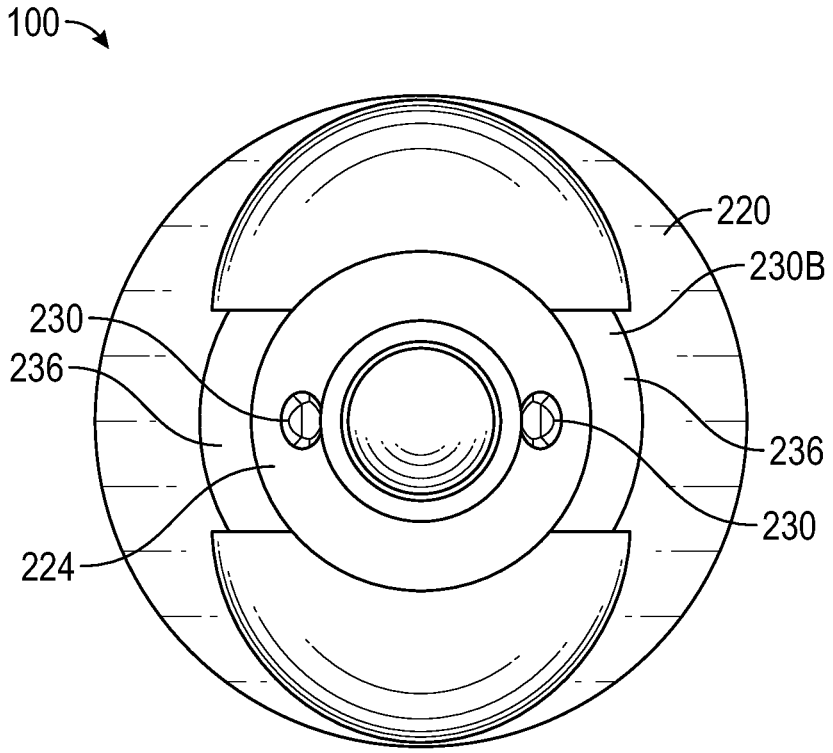
FIG. 4 is a rear view of the downhole plug of FIG. 1.

The following discussion is directed to various exemplary embodiments. However, one skilled in the art will understand that the examples disclosed herein have broad application, and that the discussion of any embodiment is meant only to be exemplary of that embodiment, and not intended to suggest that the scope of the disclosure, including the claims, is limited to that embodiment. Certain terms are used throughout the following description and claims to refer to particular features or components. As one skilled in the art will appreciate, different persons may refer to the same feature or component by different names. This document does not intend to distinguish between components or features that differ in name but not function. The drawing figures are not necessarily to scale. Certain features and components herein may be shown exaggerated in scale or in somewhat schematic form and some details of conventional elements may not be shown in interest of clarity and conciseness.

In the following discussion and in the claims, the terms "including" and "comprising" are used in an open-ended fashion, and thus should be interpreted to mean "including, but not limited to . . . ." Also, the term "couple" or "couples" is intended to mean either an indirect or direct connection. Thus, if a first device couples to a second device, that connection may be through a direct connection, or through an indirect connection via other devices, components, and connections. In addition, as used herein, the terms "axial" and "axially" generally mean along or parallel to a central axis (e.g., central axis of a body or a port), while the terms "radial" and "radially" generally mean perpendicular to the central axis. For instance, an axial distance refers to a distance measured along or parallel to the central axis, and a radial distance means a distance measured perpendicular to the central axis. Any reference to up or down in the description and the claims is made for purposes of clarity, with "up", "upper", "upwardly", "uphole", or "upstream" meaning toward the surface of the borehole and with "down", "lower", "downwardly", "downhole", or "downstream" meaning toward the terminal end of the borehole, regardless of the borehole orientation. Further, the term "fluid," as used herein, is intended to encompass both fluids and gasses.

Referring now to FIG. 1, a system 10 for completing a wellbore 4 extending into a subterranean formation 6 is shown. In the embodiment of FIG. 1, wellbore 4 is a cased wellbore including a casing string 12 secured to an inner surface 8 of the wellbore 4 using cement (not shown). In some embodiments, casing string 12 generally includes a plurality of tubular segments coupled together via a plurality of casing collars. In this embodiment, completion system 10 includes a tool string 20 disposed within wellbore 4 and suspended from a wireline 22 that extends to the surface of wellbore 4. Wireline 22 comprises an armored cable and includes at least one electrical conductor for transmitting power and electrical signals between tool string 20 and the surface. System 10 may further include suitable surface equipment for drilling, completing, and/or operating completion system 10 and may include, in some embodiments, derricks, structures, pumps, electrical/mechanical well control components, etc. Tool string 20 is generally configured to perforate casing string 12 to provide for fluid communication between formation 6 and wellbore 4 at predetermined locations to allow for the subsequent hydraulic fracturing of formation 6 at the predetermined locations.

In this embodiment, tool string 20 generally includes a cable head 24, a casing collar locator (CCL) 26, a direct connect sub 28, a plurality of perforating guns 30, a switch sub 32, a plug-shoot firing head 34, a setting tool 36, and a downhole or frac plug 100 (shown schematically in FIG. 1). Cable head 24 is the uppermost component of tool string 20 and includes an electrical connector for providing electrical signal and power communication between the wireline 22 and the other components (CCL 26, perforating guns 30, setting tool 36, etc.) of tool string 20. CCL 26 is coupled to a lower end of the cable head 24 and is generally configured to transmit an electrical signal to the surface via wireline 22 when CCL 26 passes through a casing collar, where the transmitted signal may be recorded at the surface as a collar kick to determine the position of tool string 20 within wellbore 4 by correlating the recorded collar kick with an open hole log. The direct connect sub 28 is coupled to a lower end of CCL 26 and is generally configured to provide a connection between the CCL 26 and the portion of tool string 20 including the perforating guns 30 and associated tools, such as the setting tool 36 and downhole plug 100.

Perforating guns 30 of tool string 20 are coupled to direct connect sub 28 and are generally configured to perforate casing string 12 and provide for fluid communication between formation 6 and wellbore 4. Particularly, perforating guns 30 include a plurality of shaped charges that may be detonated by a signal conveyed by the wireline 22 to produce an explosive jet directed against casing string 12. Perforating guns 30 may be any suitable perforation gun known in the art while still complying with the principles disclosed herein. For example, in some embodiments, perforating guns 30 may comprise a hollow steel carrier (HSC) type perforating gun, a scalloped perforating gun, or a retrievable tubing gun (RTG) type perforating gun. In addition, gun 30 may comprise a wide variety of sizes such as, for example, 2¾", 3⅛", or 3⅜", wherein the above listed size designations correspond to an outer diameter of perforating guns 30.

Switch sub 32 of tool string 20 is coupled between the pair of perforating guns 30 and includes an electrical conductor and switch generally configured to allow for the passage of an electrical signal to the lowermost perforating gun 30 of tool string 20. Tool string 20 further includes plug-shoot firing head 34 coupled to a lower end of the lowermost perforating gun 30. Plug-shoot firing head 34 couples the perforating guns 30 of the tool string 20 to the setting tool 36 and downhole plug 100, and is generally configured to pass a signal from the wireline 22 to the setting tool 36 of tool string 20. Plug-shoot firing head 34 may also include mechanical and/or electrical components to fire the setting tool 36.

In this embodiment, tool string 20 further includes setting tool 36 and downhole plug 100, where setting tool 36 is coupled to a lower end of plug-shoot firing head 34 and is generally configured to set or install downhole plug 100 within casing string 12 to isolate desired segments of the wellbore 4. As will be discussed further herein, once downhole plug 100 has been set by setting tool 36, an outer surface of downhole plug 100 seals against an inner surface of casing string 12 to restrict fluid communication through wellbore 4 across downhole plug 100. Setting tool 36 of tool string 20 may be any suitable setting tool known in the art while still complying with the principles disclosed herein. For example, in some embodiments, tool 34 may comprise a #10 or #20 Baker style setting tool. In addition, setting tool 36 may comprise a wide variety of sizes such as, for example, 1.68 in., 2.125 in., 2.75 in., 3.5 in., 3.625 in., or 4 in., wherein the above listed sizes correspond to the overall outer diameter of the tool. Additionally, although downhole plug 100 is shown in FIG. 1 as incorporated in tool string 20, downhole plug 100 may be used in other tool strings comprising components differing from the components comprising tool string 20.

Referring to FIGS. 1-13, an embodiment of the downhole plug 100 of the tool string 20 of FIG. 1 is shown in FIGS. 2-13. In the embodiment of FIGS. 2-13, downhole plug 100 has a central or longitudinal axis 105 and generally includes a mandrel 102, an engagement disk 130, a body lock ring assembly 140, a first clamping member 160, an elastomeric member or packer 170, a second clamping member 180, a slip assembly 200, and a nose cone 220.

In this embodiment, mandrel 102 of downhole plug 100 has a first end 102A, a second end 102B, a central bore or passage 104 defined by a generally cylindrical inner surface 106 extending between ends 102A, 102B, and a generally cylindrical outer surface 108 extending between ends 102A, 102B. The inner surface 106 of mandrel 102 includes a frustoconical seat 110 proximal first end 102A. As will be discussed further herein, following the setting of downhole plug 100, a ball or dart 300 may be pumped into wellbore 4 for seating against seat 110 such that fluid flow through central bore 104 of mandrel 102 is restricted. In this embodiment, the first end 102A of mandrel 102 includes a pair of circumferentially spaced arcuate slots or recesses 112. Additionally, in this embodiment, the outer surface 108 of mandrel 102 includes an expanded diameter portion 114 at first end 102A that forms an annular shoulder 116. Expanded diameter portion 114 of outer surface 108 includes a plurality of circumferentially spaced apertures 118 configured to receive a plurality of connecting members for coupling mandrel 102 with setting tool 36. Mandrel 102 includes a plurality of ratchet teeth 120 that extend along a portion of outer surface 108 proximal shoulder 116. Further, in this embodiment, the outer surface 108 of mandrel 102 includes a connector 122 located proximal to second end 102B.

Engagement disk 130 of downhole plug 100 is disposed about mandrel 102 and has a first end 130A and a second end 130B. In this embodiment, first end 130A of engagement disk 130 comprises an annular engagement surface 130A configured to engage a corresponding annular engagement surface of setting tool 36 for actuating downhole plug 100 from a first or run-in position shown in FIG. 8 to a second or set position shown in FIG. 13, as will be discussed further herein. In the run-in position of downhole plug 100, engagement surface 130A of engagement disk 130 is disposed directly adjacent or contacts shoulder 116 of mandrel 102. In this embodiment, the second end 130B of engagement disk 130 includes an anti-rotation hexagonal shoulder or protrusion 132 extending axially therefrom.

In this embodiment, the body lock ring assembly 140 of downhole plug 100 comprises a plurality of circumferentially spaced arcuate lock ring segments 142 disposed about mandrel 102, and an annular lock ring retainer 150 disposed about lock ring segments 142. Each lock ring segment 142 includes a first end 142A, a second end 142B, and an arcuate inner surface extending between ends 142A, 142B that comprises a plurality of ratchet teeth 144. Ratchet teeth 144 matingly engage the ratchet teeth 120 of mandrel 102 to restrict relative axial movement between lock ring segments 142 and mandrel 102. Particularly, the mating engagement between ratchet teeth 144 of lock ring segments 142 and ratchet teeth 120 of mandrel 102 prevent lock ring segments 142 from travelling axially towards the first end 102A of mandrel 102, but permits lock ring segments 142 to travel axially towards the second end 102B of mandrel 102. Additionally, each lock ring segment 142 includes an outer surface extending between ends 142A, 142B, that comprises an arcuate groove 146 disposed proximate first end 142A and a generally frustoconical surface 148 extending from second end 142B. Lock ring retainer 150 retains lock ring segments 142 in position about mandrel 102 such that segments 142 do not move axially relative to each other.

First clamping member 160 of downhole plug 100 is generally annular and is disposed about mandrel 102 between engagement disk 130 and packer 170. In this embodiment, first clamping member 160 has a first end 160A, a second end 160B, and a generally cylindrical inner surface extending between ends 160A, 160B that includes a first frustoconical surface 162 located proximal first end 160A and a second frustoconical surface 164 extending from second end 160B. Additionally, in this embodiment, first clamping member 160 includes a hexagonal recess 166 that extends axially into the first end 160A of first clamping member 160. Hexagonal recess 166 of first clamping member 160 is configured to matingly receive the hexagonal shoulder 132 of engagement disk 130 to thereby restrict relative rotation between first clamping member 160 and engagement disk 130. Although in this embodiment hexagonal shoulder 132 of engagement disk 130 and hexagonal recess 166 of first clamping member 160 are each six-sided in shape, in other embodiments, shoulder 132 and recess 166 may comprise varying number of sides. Additionally, as will be described further herein, the first frustoconical surface 162 of first clamping member 160 is configured to matingly engage the frustoconical surface 148 of each lock ring segment 142 when downhole plug 100 is set in wellbore 4. Although in this embodiment engagement disk 130 comprises shoulder 132 and first clamping member 160 comprises recess 166, in other embodiments, first clamping member 160 may comprise a hexagonal shoulder or protrusion while engagement disk 130 comprises a corresponding hexagonal recess configured to receive the shoulder of the first clamping member 160 to restrict relative rotation between engagement disk 130 and first clamping member 160.

Packer 170 of downhole plug 100 is generally annular and disposed about mandrel 102 between first clamping member 160 and second clamping member 180. Packer 170 comprises an elastomeric material and is configured to sealingly engage an inner surface 14 of casing string 12 when downhole plug 100 is set, as shown particularly in FIG. 13. In this embodiment, packer 170 comprises a generally cylindrical outer surface 172 extending between first and second ends of packer 170. Outer surface 172 of packer 170 includes a pair of frustoconical surfaces 174 extending from each end of packer 170.

Second clamping member 180 of downhole plug 100 is generally annular and is disposed about mandrel 102 between packer 170 and slip assembly 200. In this embodiment, second clamping member 180 has a first end 180A, a second end 180B, and a generally cylindrical inner surface extending between ends 180A, 180B that includes an inner frustoconical surface 182 extending from first end 180A. Additionally, second clamping member 180 includes a generally cylindrical outer surface extending between ends 180A, 180B that includes a plurality of circumferentially spaced planar (e.g., flat) surfaces 184 extending from second end 180B. Each planar surface 184 extends at an angle relative to the central axis 105 of downhole plug 100. In some embodiments, friction resulting from contact between the elastomeric material comprising packer 170 and frustoconical surfaces 164 and 182 of clamping members 160, 180, respectively, assists in preventing relative rotation between packer 170 and clamping members 160, 180.

Slip assembly 200 is generally configured to engage or "bite into" the inner surface 14 of casing string 12 when downhole plug 100 is actuated into the set position to couple or affix downhole plug 100 to casing string 12, thereby restricting relative axial movement between downhole plug 100 and casing string 12. In this embodiment, slip assembly 200 comprises a plurality of circumferentially spaced arcuate slip segments 202 disposed about mandrel 102, and a pair of axially spaced annular retainers 215 each disposed about the slip segments 202. In this embodiment, each slip segment 202 includes a first end 202A, a second end 202B, and an arcuate inner surface extending between ends 202A, 202B that includes a planar (e.g., flat) surface 204 extending from first end 202A. The planar surface 204 of each slip segment 202 extends at an angle relative to central axis 105 of downhole plug 105 and is configured to matingly engage one of the planar surfaces 184 of second clamping member 180.

The planar (e.g., flat) interface formed between each corresponding planar surface 184 of clamping member 180 and each planar surface 204 of slip segments 202 restricts relative rotation between second clamping member 180 and slip segments 202. Additionally, as will be described further herein, relative axial movement between second clamping member 180 and slip assembly 200 is configured to force slip segments 202 radially outwards, snapping retainers 215, via the angled or cammed sliding contact between planar surfaces 184 of second clamping member 180 and the planar surfaces 204 of slip segments 202. In this embodiment, retainers 215 each comprise a filament wound band; however, in other embodiments, retainers 215 may comprise various materials and may be formed in varying ways.

In this embodiment, each retainer ring 202 includes a generally arcuate outer surface extending between ends 202A, 202B that includes a plurality of engagement members 206. Engagement members 206 are configured to engage or bite into the inner surface 14 of casing string 12 when downhole plug 100 is actuated into the set position to thereby affix downhole plug 100 to casing string 12 at a desired or predetermined location. Thus, engagement members 206 comprise a suitable material for engaging with inner surface 14 of casing string 12 during operations. For example, engagement members 206 may comprise 8620 Chrome-Nickel-Molybdenum alloy, carbon steel, tungsten carbide, cast iron, and/or tool steel. In some embodiments, engagement members 206 may comprise a composite material. Additionally, in this embodiment, each slip segment 202 of slip assembly 200 includes a pocket or receptacle 208 located at the second end 202B which extends into the inner surface of the slip segment 202.

Nose cone 2202 of downhole plug 100 is generally annular and is disposed about the second end 102B of mandrel 102. Nose cone 220 has a first end 220A, a second end 220B, a central bore or passage 222 defined by a generally cylindrical inner surface 224 extending between ends 220A, 220B, and a generally cylindrical outer surface 226 extending between ends 220A, 220B. In this embodiment, the inner surface 224 of nose cone 200 includes a connector 228 that releasably or threadably couples with the connector 122 of mandrel 102 to restrict relative axial movement between mandrel 102 and nose cone 220. Additionally, in this embodiment, nose cone 220 includes a plurality of circumferentially spaced protrusions or notches 230 extending from inner surface 224. As will be discussed further herein, protrusions 230 prevent ball 300 from seating and sealing against inner surface 224. Thus, in the event that ball 300 lands against inner surface 224 of nose cone 220, protrusions 230 will contact ball 300 to maintain fluid communication between passage 222 of nose cone 220 and passage 104 of mandrel 102.

In this embodiment, the outer surface 226 of nose cone 220 includes a plurality of axially spaced annular fins 232. Fins 232 increase the surface area of outer surface 226 to facilitate the creation of turbulent fluid flow around fins 232 when downhole plug 100 is pumped through wellbore 4 along with the other components of tool string 20. The turbulent fluid flow created by fins 232 increases the pressure differential in wellbore 4 between the uphole and downhole ends of downhole plug 100, thereby reducing the amount of fluid in wellbore 4 that flows around downhole plug 100 as downhole plug 100 is pumped through wellbore 4. The reduction in fluid that flows around downhole plug 100 reduces the total volume of fluid required to pump tool string 20 into the desired or predetermined position in wellbore 4, thereby reducing the cost of completing wellbore 4.

Figure 5:
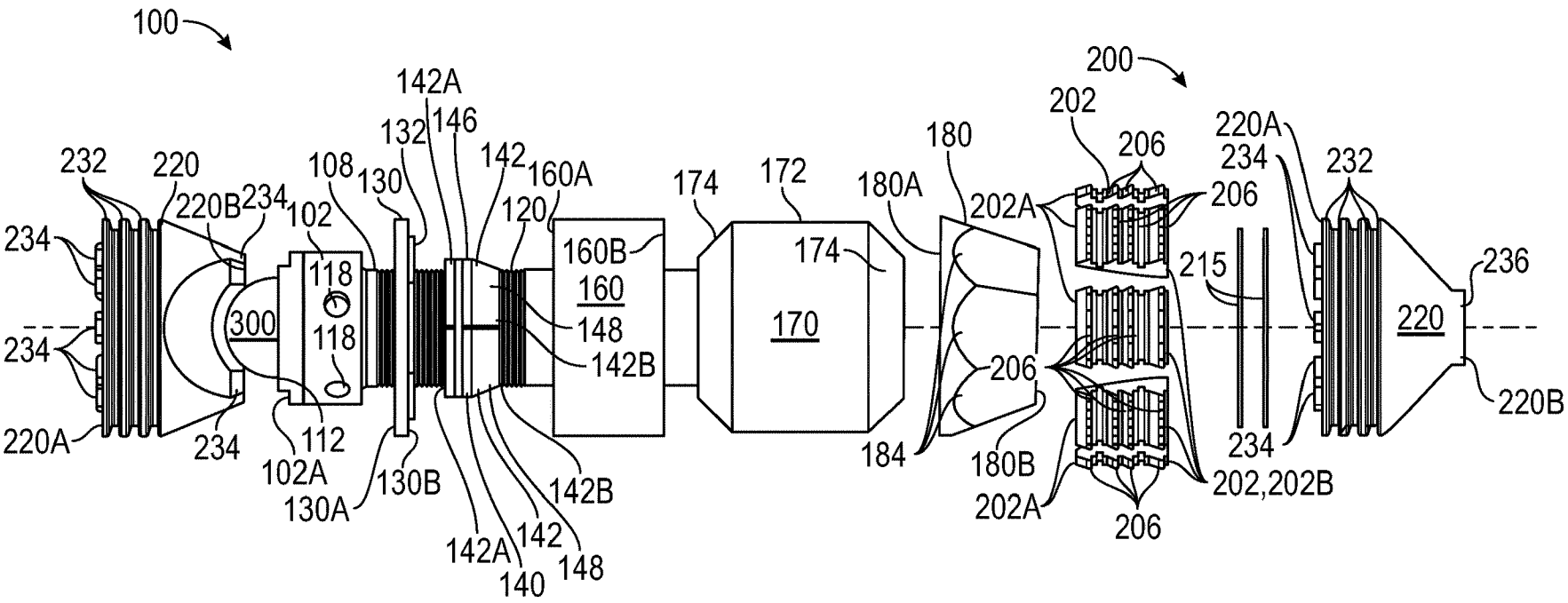
FIG. 5 is an exploded side view of the downhole plug of FIG. 1.
Figure 6:
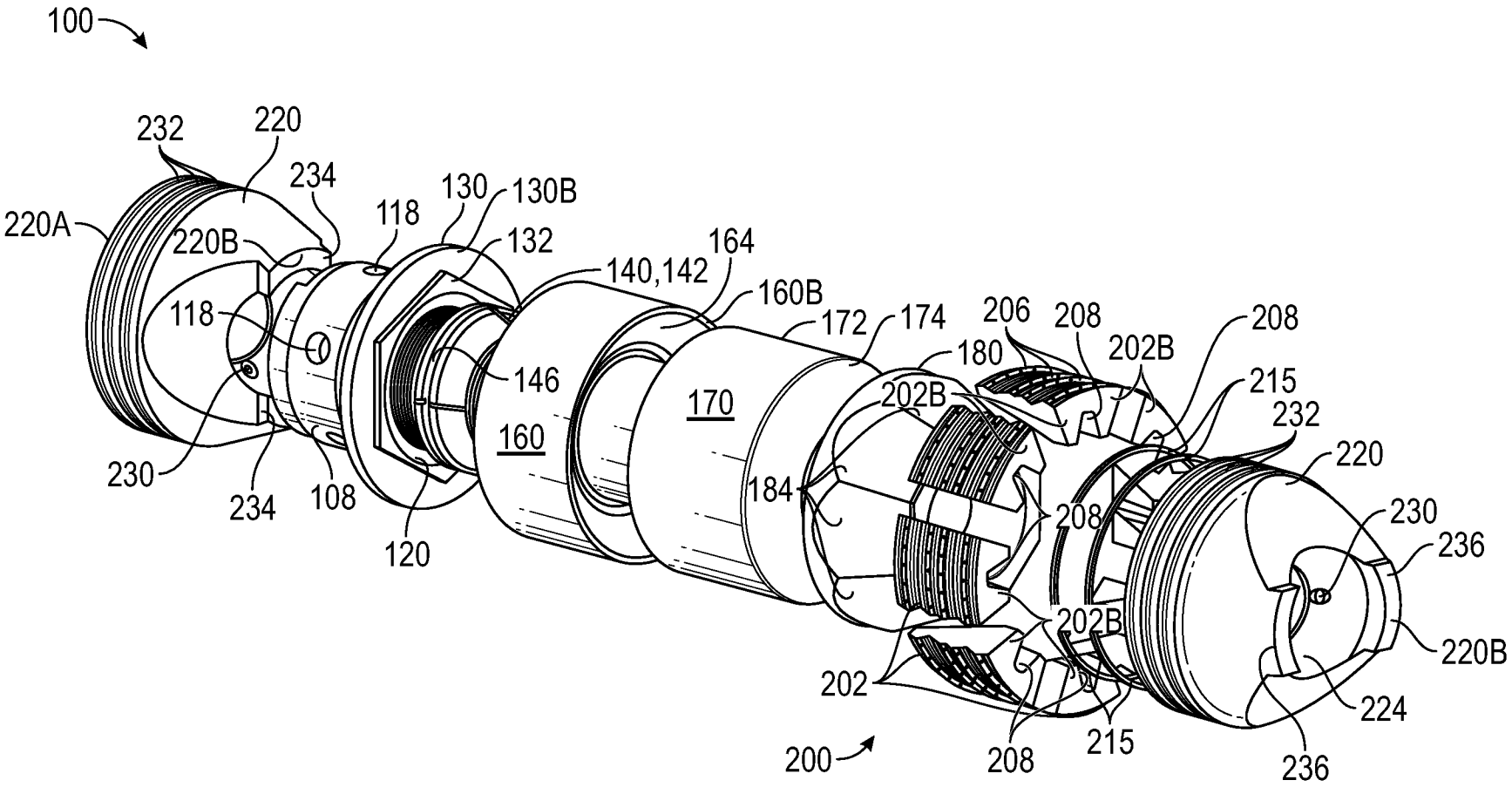
FIGS. 6 and 7 are exploded perspective views of the downhole plug of FIG. 1.
Figure 7:
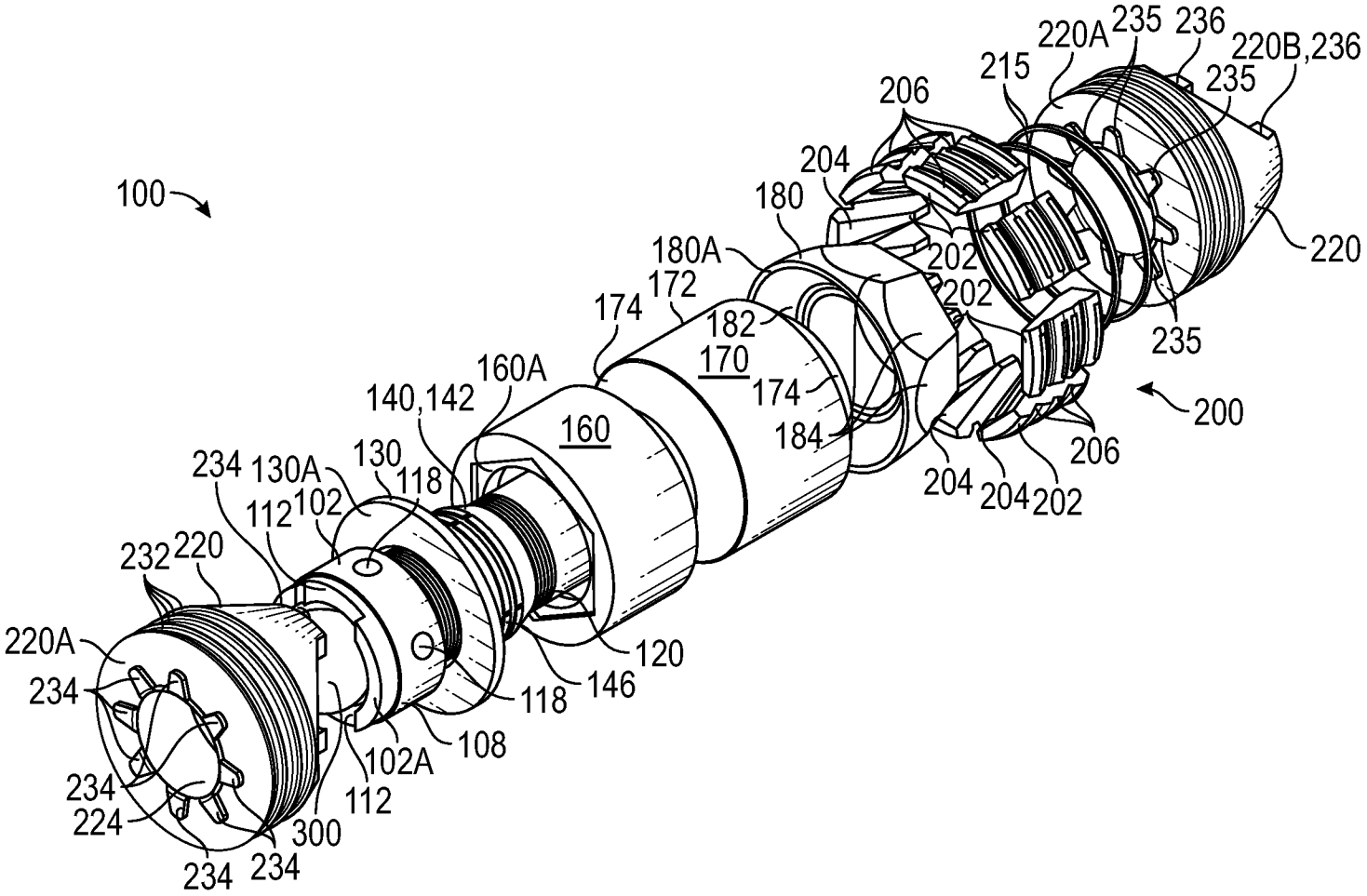
Figure 8:
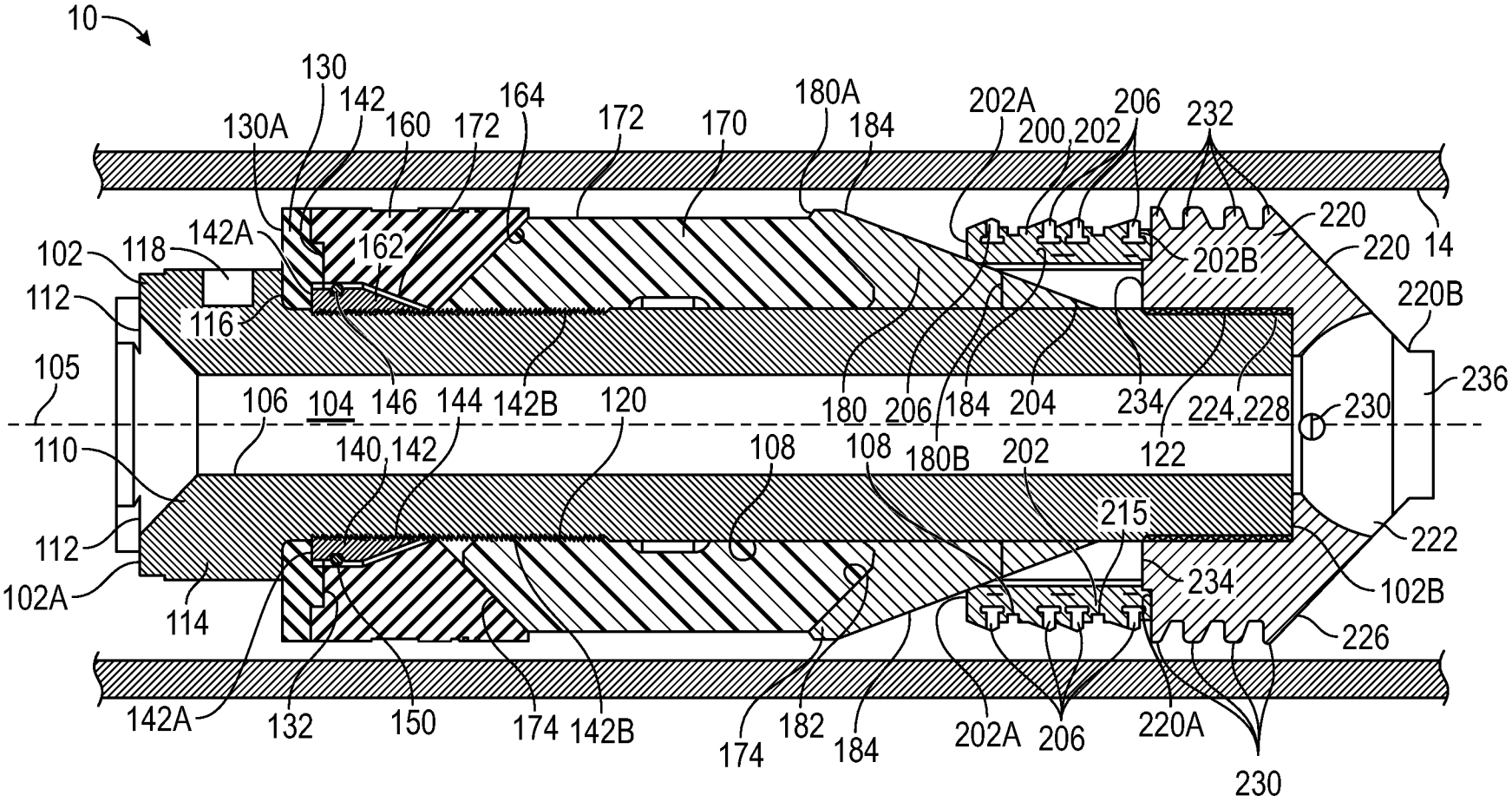
FIG. 8 is side cross-sectional view of the downhole plug of FIG. 1 in a run-in position in accordance with principles disclosed herein.
Figure 9:
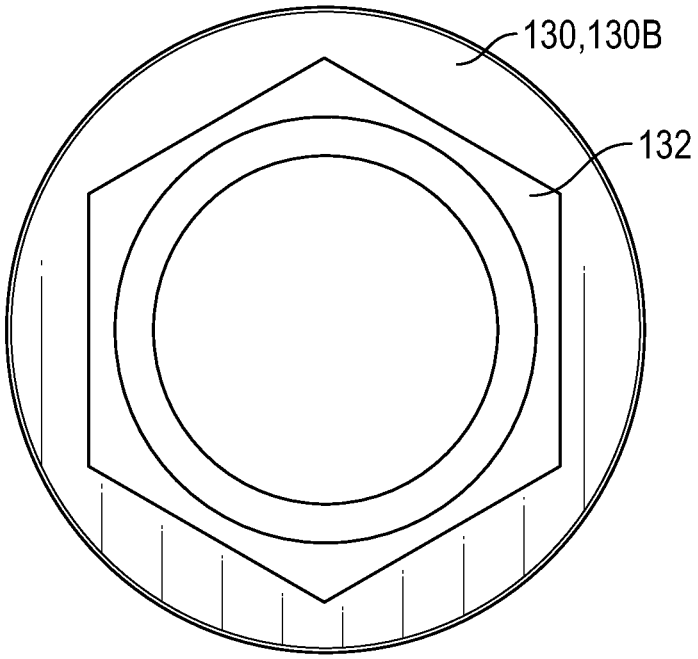
FIG. 9 is a rear view of an embodiment of an engagement disk of the downhole plug of FIG. 1 in accordance with principles disclosed herein.
Figure 10:
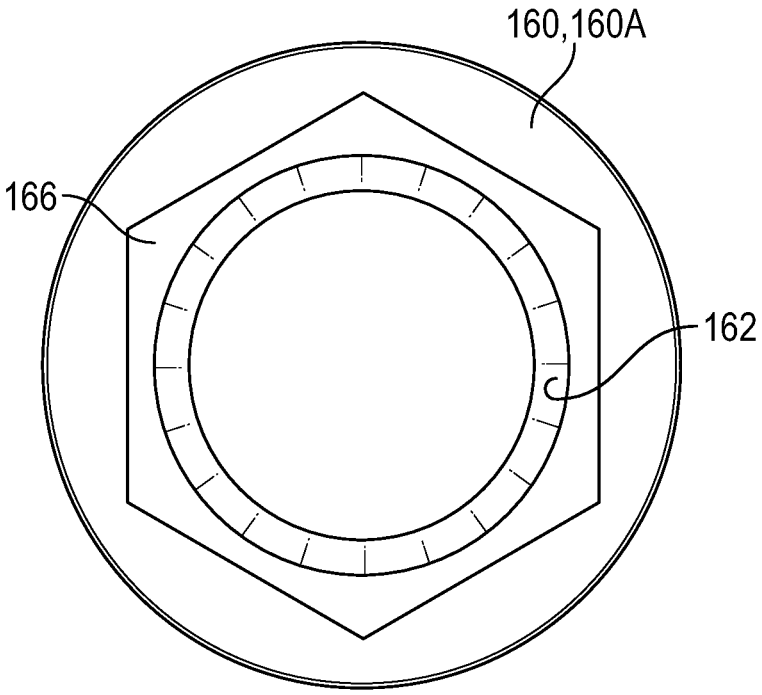
FIG. 10 is a front view of an embodiment of a clamping member of the downhole plug of FIG. 1 in accordance with principles disclosed herein.
Figure 11:
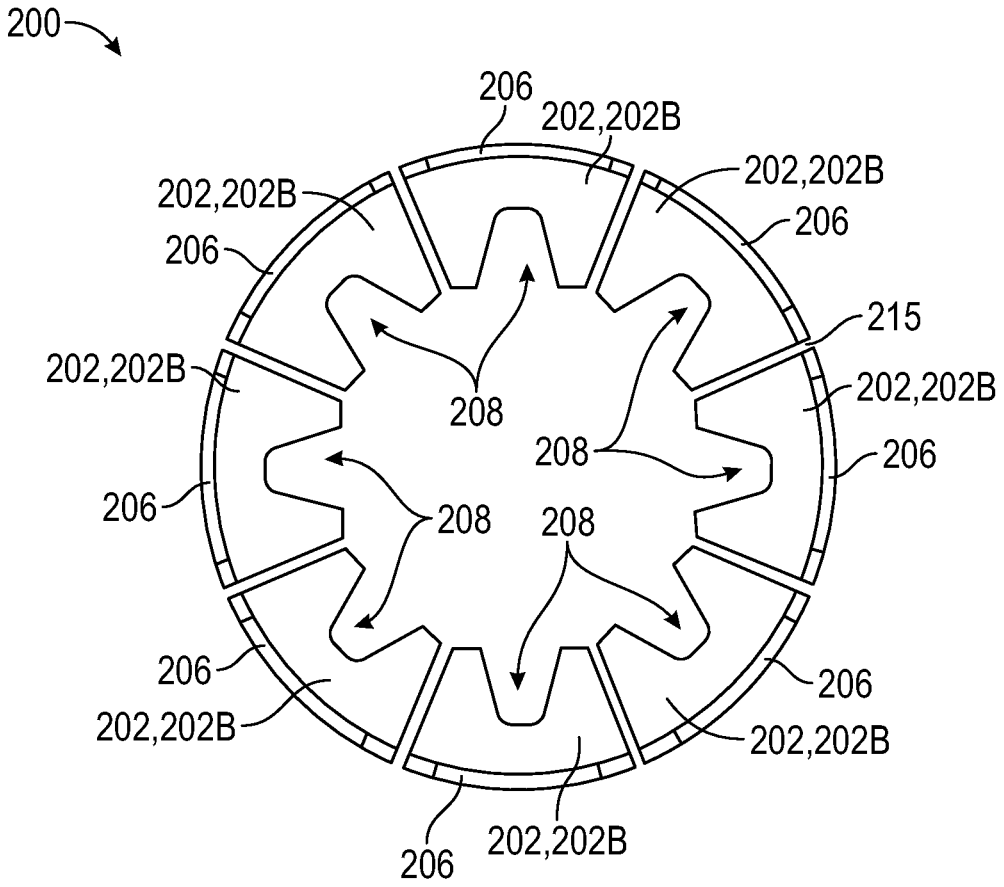
FIG. 11 is a rear view of an embodiment of a slip assembly of the downhole plug of FIG. 1 in accordance with principles disclosed herein.
Figure 12:
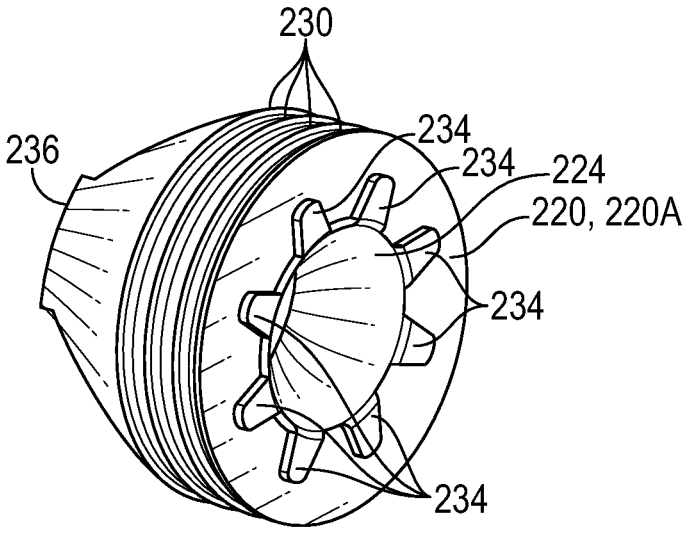
FIG. 12 is a perspective view of an embodiment of a nose cone of the downhole plug of FIG. 1 in accordance with principles disclosed herein.
Figure 13:
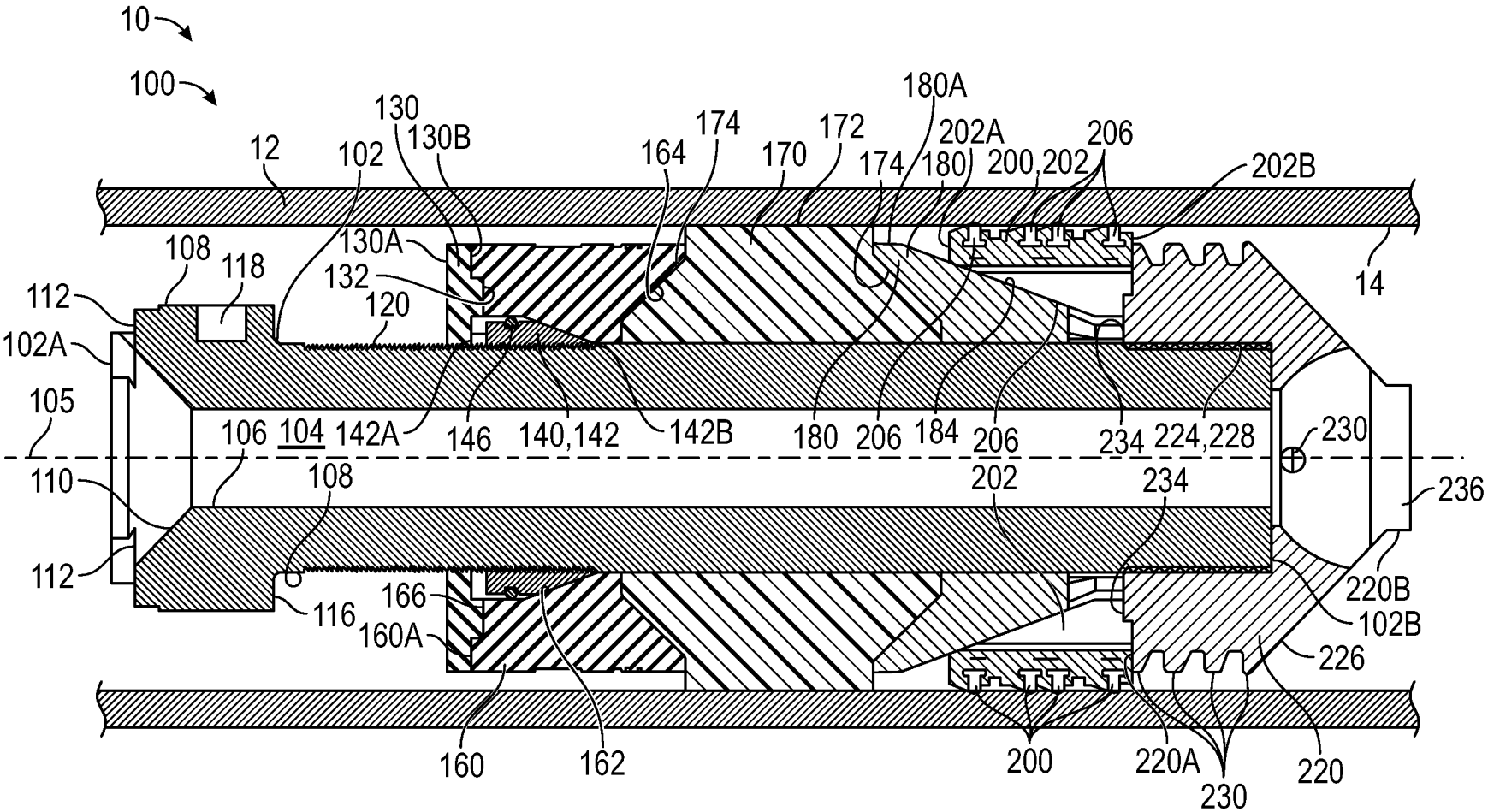
FIG. 13 is side cross-sectional view of the downhole plug of FIG. 1 in a set position in accordance with principles disclosed herein.
Figure 14:
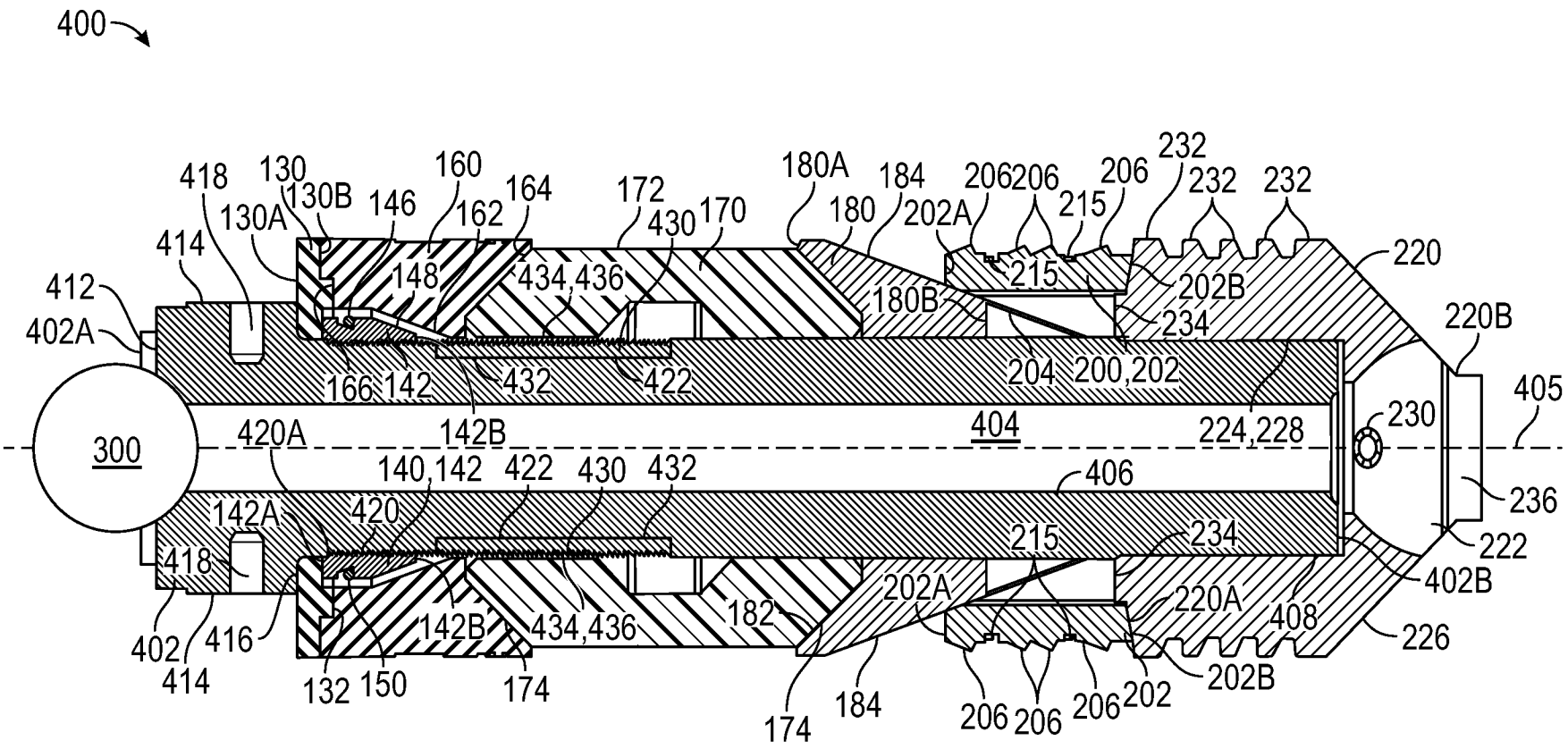
FIG. 14 is a side cross-sectional view of another embodiment of a downhole plug in accordance with the principles disclosed herein.
Figure 15:
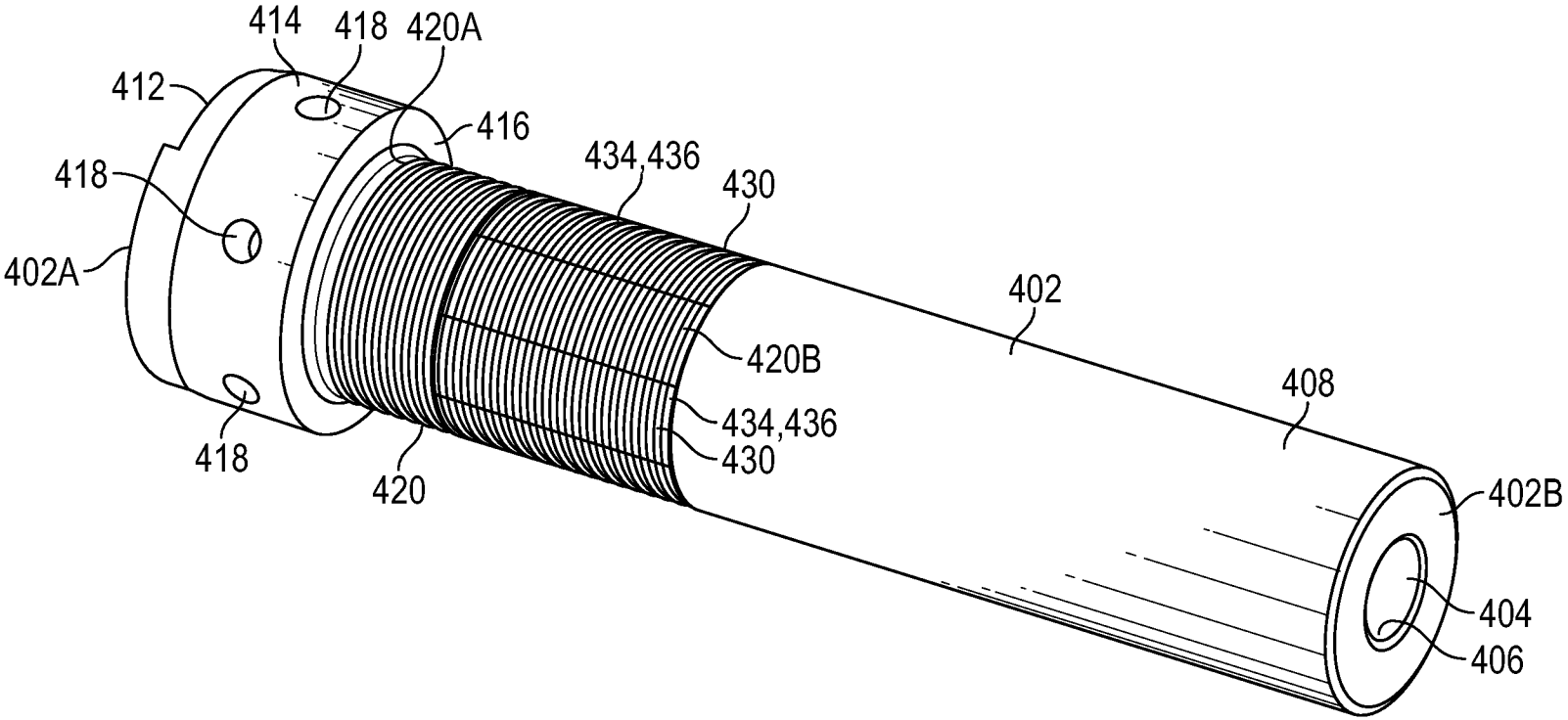
FIG. 15 is a perspective view of an embodiment of a mandrel of the downhole plug 14 in accordance with the principles disclosed herein.
Figure 16:
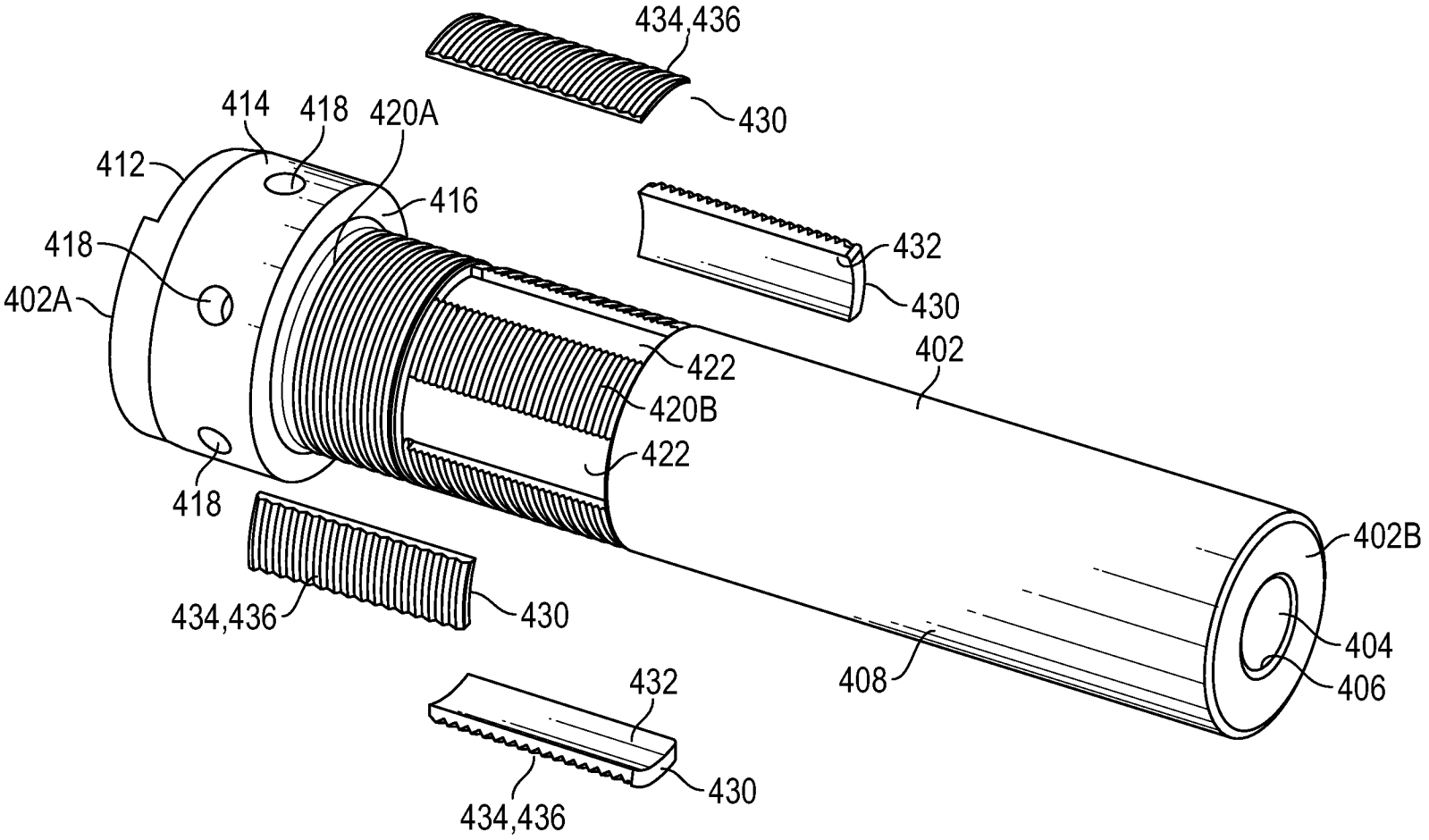
FIG. 16 is an exploded perspective view of the mandrel of FIG. 15.
Figure 17:
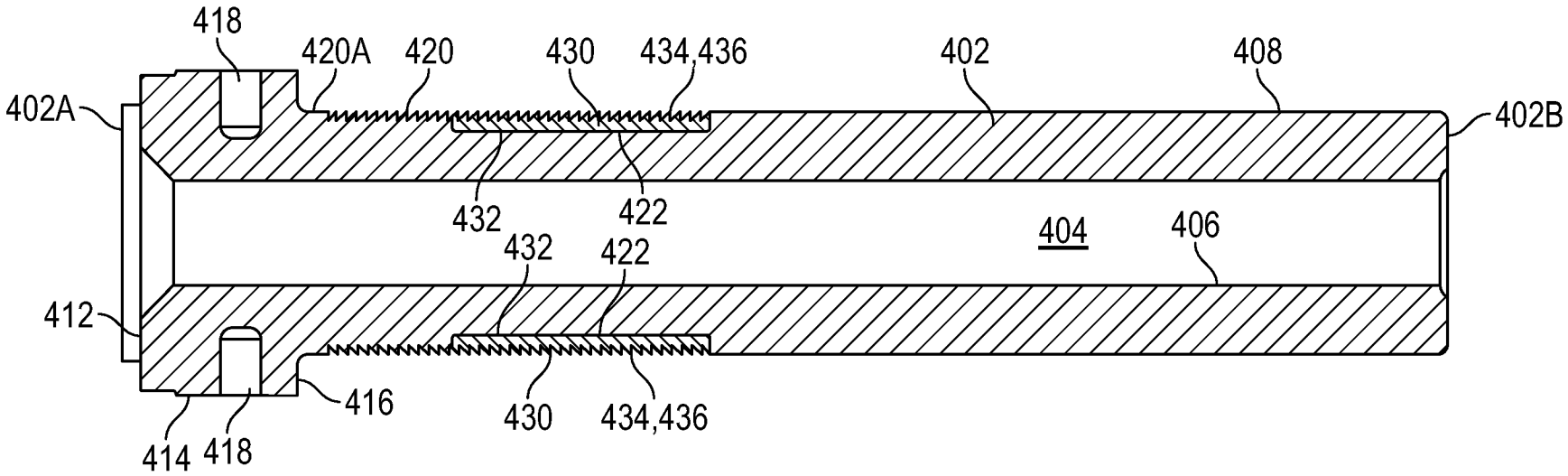
FIG. 17 is a side cross-sectional view of the mandrel of FIG. 15.

In this embodiment, nose cone 220 includes a plurality of circumferentially spaced protrusions or notches 234 extending axially from first end 220A of nose cone 220. Protrusions 234 of nose cone 220 are matingly received in pockets 208 of slip segments 202 to form an interlocking engagement between nose cone 220 and the slip segments 202 of slip assembly 200. The interlocking engagement formed between protrusions 234 of nose cone 220 and pockets 208 of slip segments 202 restrict relative rotation between slip segments 202 and nose cone 220. Additionally, the interlocking engagement between protrusions 234 and pockets 208 spaces slip segments equidistantly relative to each other about central axis 105 of downhole plug 100. Equidistant circumferential spacing of slip segments 202 ensures generally uniform contact and coupling between slip assembly 200 and the inner surface 14 of casing string 12 about the entire circumference of downhole plug 100. Further, in this embodiment, nose cone 220 includes a pair of circumferentially spaced arcuate clutching members or protrusions 236 that extend axially from second end 220B of nose cone 220. As will be discussed further herein, protrusions 236 of the nose cone 220 of downhole plug 100 are configured to be matingly received in the slots 112 of an adjacent downhole plug 100 disposed farther downhole in wellbore 4 to prevent relative rotation between the two downhole plugs 100 (FIGS. 5-7 illustrate an adjacently disposed nose cone 220 for clarity).

Downhole plug 100 includes multiple components comprising nonmetallic materials. Particularly, in this embodiment, engagement disk 130, first clamping member 170, and nose cone 220 are each molded from nonmetallic materials. In some embodiments, engagement disk 130, first clamping member 170, and nose cone 220 are injection or compression molded from various high performance resins. By forming engagement disk 130, first clamping member 170, and nose cone 220 using nonmetallic materials, components 130, 170, and 220 may include features including complex or irregular geometries that are easily and conveniently formed using a molding process. For instance, protrusions 230 and fins 232 of nose cone 220 are conveniently formed using a molding process whereas such features may be relatively difficult to form using a machining process.

As described above, downhole plug 100 is pumped downhole though wellbore 4 along with the other components of tool string 20. As tool string 20 is pumped through wellbore 4, the position of tool string 20 in wellbore 4 is monitored at the surface via signals generated from CCL 26 and transmitted to the surface using wireline 22. Once tool string 20 is disposed in a desired location in wellbore 4, one or more of perforating guns 30 may be fired to perforate casing 12 at the desired location and setting tool 36 may be fired or actuated to actuate downhole plug 100 from the run-in position shown in FIG. 8 to the set position shown in FIG. 13.

Particularly, setting tool 36 includes an inner member or mandrel (not shown) that moves axially relative to an outer member or housing of setting tool 36 upon the actuation of tool 36. The mandrel of setting tool 36 is coupled to mandrel 102 of downhole plug 100 such that the movement of the mandrel of setting tool 36 pulls mandrel 102 uphole (e.g., towards setting tool 36). Additionally, the outer member of setting tool 36 contacts engagement surface 130A of engagement disk 130 to prevent disk 130, clamping members 160, 180, packer 170, and slip assembly 200 from travelling in concert with mandrel 102, thereby providing relative axial movement between mandrel 102 and disk 130, clamping members 160, 180, packer 170, and slip assembly 200.

As mandrel 102 travels uphole towards setting tool 36, the first end 220A of nose cone 220 and the second end 130B of engagement disk 130 apply an axially compressive force against clamping members 160, 180, packer 170, and slip assembly 200. In response to the application of the compressive force, slip segments 202 are forced radially outward towards casing string 12 as planar surfaces 184 of second clamping member 180 slide along the planar surfaces 204 of slip segments 202, snapping retainers 215. Slip segments 202 continue to travel radially outwards until engagement members 206 contact and couple to the inner surface 14 of casing string 12, locking downhole plug 100 to casing string 12 at the desired location in wellbore 4. Additionally, each end of packer 170 is compressed via contact between frustoconical surfaces 174 of packer 170 and frustoconical surfaces 164, 182 of clamping members 160, 180, respectively. The axially directed compressive force applied to packer 170 forces the outer surface 172 of packer 170 into sealing engagement with the inner surface 14 of casing string 12. With outer surface 172 of packer 170 sealing against the inner surface 14 of casing string 12, the only fluid flow permitted between the uphole and downhole ends of downhole plug 100 is permitted via passage 104 of mandrel 102.

Following the coupling of slip segments 202 with casing string 12 and the sealing of packer 170 against casing string 12 (shown in FIG. 13), setting tool 36 may be disconnected from downhole plug 100, allowing setting tool 36 and the other components of tool string 20 to be retrieved to the surface of wellbore 4, with downhole plug 100 remaining at the desired location in wellbore 4. Once setting tool 36 is released from downhole plug 100, contact between frustoconical surface 162 of first clamping member 160 and the frustoconical surfaces 148 of lock ring segments 142 applies an axial and radially inwards force against each lock ring segment 142. However, engagement between ratchet teeth 144 of lock ring segments 142 and ratchet teeth 120 of mandrel 102 prevent lock ring segments 142 from moving axially uphole relative to mandrel 102. With lock ring segments 142 prevented from travelling uphole in the direction of the upper end 102A of mandrel 102, downhole plug 100 is held in the set position shown in FIG. 13. Additionally, with lock ring assembly 140 comprising a plurality of arcuate lock ring segments 142, instead of a single lock ring (e.g., a C-ring), the radially inwards directed force applied by the frustoconical surface 162 of first clamping member 160 is evenly applied against each lock ring segment 142. The relatively even distribution of the radially inwards to each lock ring segment 142 assists in securing downhole plug 100 in the set position.

After tool string 20 has been retrieved from the wellbore 4, ball 300 may be pumped into and through wellbore 4 until ball 300 lands against seat 110 of mandrel 102. With ball 300 seated on seat 110 of mandrel 102, fluid flow through passage 104 of mandrel 102 is restricted which, in conjunction with the seal formed by packer 170 against the inner surface 14 of casing string 12, seals the portion of wellbore 4 extending downhole from downhole plug 100 from the surface. Thus, additional fluid pumped into wellbore 4 from the surface is then directed through the perforations previously formed in casing string 12 by one or more of the perforating guns 30, thereby hydraulically fracturing the formation 6 at the desired location in wellbore 4.

In some embodiments, the hydraulic fracturing process described above is repeated a plurality of times at a plurality of desired locations in wellbore 4 moving towards the surface of wellbore 4. After the formation 6 has been hydraulically fractured at each desired location in wellbore 4, a tool may be deployed in wellbore 4 to drill out each downhole plug 100 disposed therein to allow fluids in formation 6 to flow to the surface via wellbore 4. With conventional downhole plugs, issues may arise during this drilling process if relative rotation is permitted either between components of each plug, or between separate plugs as the drill proceeds to drill out each conventional plug disposed in the borehole. However, in this embodiment, downhole plug 100 includes anti-rotation features configured to prevent, or at least inhibit, relative rotation between components thereof and between separate downhole plugs 100 disposed in wellbore 4. Particularly, as described above: hexagonal shoulder 132 and hexagonal recess 166 of engagement disk 130 and first clamping member 160, respectively, restrict relative rotation therebetween; frictional engagement between packer 170 and clamping members 160, 180 restrict or inhibit relative rotation therebetween; planar engagement between planar surfaces 184 of second clamping member 180 and planar surfaces 204 of slip segments 202 restrict relative rotation therebetween; pockets 208 of slip segments 202 and protrusions 234 of nose cone 220 restrict relative rotation therebetween; and engagement between notches 236 of the nose cone 220 of an uphole-positioned downhole plug 100 and slots 112 of the mandrel 102 of a downhole-positioned downhole plug 100 restrict relative rotation between the uphole and downhole positioned downhole plugs 100. Although in this embodiment nose cone 220 comprises notches 236 and mandrel 102 comprises slots 112, in other embodiments, mandrel 102 of a first downhole plug 100 may comprise notches or protrusions while a nose cone 220 of a second downhole plug 100 comprises corresponding slots or recesses configured to receive the notches of the mandrel 102 of the first downhole plug 100. Additionally, although in this embodiment nose cone 220 comprises notches 234 and slip segments 202 comprise pockets 208, in other embodiments, slip segments 202 may include notches or protrusions while nose cone 220 comprises corresponding pockets or recesses configured to receive the notches of slip segments 202.

Referring to FIGS. 14-17, another embodiment of a downhole plug 400 for use with the tool string 20 of FIG. 1 (in lieu of the downhole plug 100 shown in FIGS. 2-13) is shown in FIGS. 14-17. In the embodiment of FIGS. 14-17, downhole plug 400 has a central or longitudinal axis 405 and includes features in common with the downhole plug 100 shown in FIGS. 2-13, and shared features are labeled similarly. Particularly, downhole plug 400 is similar to downhole plug 100 except that downhole plug 400 includes a mandrel 402 that receives a plurality of circumferentially spaced arcuate inserts 430, as will be described further herein.

In this embodiment, mandrel 402 of downhole plug 400 has a first end 402A, a second end 402B, a central bore or passage 404 defined by a generally cylindrical inner surface 406 extending between ends 402A, 402B, and a generally cylindrical outer surface 408 extending between ends 402A, 402B. The inner surface 406 of mandrel 402 includes a frustoconical seat 410 proximal first end 402A. In this embodiment, the first end 402A of mandrel 402 includes a pair of circumferentially spaced arcuate slots or recesses 412. Additionally, in this embodiment, the outer surface 408 of mandrel 402 includes an expanded diameter portion 414 at first end 402A that forms an annular shoulder 416. Expanded diameter portion 414 of outer surface 408 includes a plurality of circumferentially spaced apertures 418 configured to receive a plurality of connecting members for coupling mandrel 102 with setting tool 36. Additionally, mandrel 402 includes a plurality of ratchet teeth 420 that extend along a portion of outer surface 408 proximal shoulder 416. In some embodiments, the outer surface 408 of mandrel 402 may include a connector located proximal to second end 402B for releasably or threadably coupling with the connector 228 of nose cone 200.

Unlike the mandrel 102 of the downhole plug 100 shown in FIGS. 2-13, the mandrel 402 of downhole plug 400 includes a plurality of circumferentially spaced, arcuate recesses 422 (shown in FIG. 16) formed in the outer surface 508 of mandrel 402 that axially overlap the ratchet teeth 420. As shown particularly in FIGS. 15 and 16, ratchet teeth 420 extend between a first end 420A and a second end 420B, where each arcuate recess 422 extends axially from the second end 420B of ratchet teeth 420B towards the first end 420A. Each arcuate recess 422 of mandrel 402 is configured to matingly receive one of the arcuate inserts 430, as shown particularly in FIG. 15. In this embodiment, mandrel 402 includes four circumferentially spaced arcuate recesses 422 that matingly receive four arcuate inserts 430; however, in other embodiments, the mandrel 402 of downhole plug 400 may include varying numbers of arcuate recesses 422 and corresponding arcuate inserts 430. In this embodiment, each arcuate insert 430 includes an arcuate inner surface 432 that matingly engages a corresponding arcuate recess 422 of mandrel 402, and an arcuate outer surface 434 that includes a plurality of arcuate ratchet teeth 436 formed thereon. When arcuate inserts 430 are matingly received in the arcuate recesses 422 of mandrel 402, the ratchet teeth 436 of each arcuate insert 430 axially aligns with the ratchet teeth 420 formed on the outer surface 408 of mandrel 402. In this embodiment, arcuate inserts 430 are each molded and comprise a nonmetallic material. In this embodiment, the inner surface 432 of each arcuate insert 430 is adhered or glued to one of the recesses 422 of mandrel 402; however, in other embodiments, other mechanisms may be employed for coupling arcuate inserts 430 with mandrel 402.

In this embodiment, arcuate inserts 430 are generally configured to provide additional shear strength so that ratchet teeth 420 are not inadvertently stripped or otherwise damaged during the operation of downhole plug 400. For instance, in some embodiments, mandrel 402 comprises fiber or filament wound tubing while arcuate inserts 430 each comprise a composite material; however, in other embodiments, the mandrel 402 and arcuate inserts 430 may comprise varying materials. The material from which mandrel 402 is formed may have a relatively high tensile strength to sustain the tensile loads applied to it by setting tool 36, but may be relatively weak in shear. Thus, arcuate inserts 430 may comprise a material that is relatively stronger in shear (e.g., a composite material) than the material of which mandrel 402 is comprised. In other words, in an embodiment, mandrel 402 comprises a first material having a first shear strength while each arcuate insert 430 comprises a second material having a second shear strength, where the second shear strength is greater than the first shear strength.

During the operation of downhole plug 400, shear loads may be transferred from ratchet teeth 142 of lock ring segments 140 to the relatively strong or shear resistant ratchet teeth 434 of arcuate inserts 430 which matingly engage ratchet teeth 142, thereby mitigating the risk of ratchet teeth 420 of mandrel 402 being sheared off or otherwise damaged by the shear loads transferred from ratchet teeth 142. In some embodiments, a majority of the shear loads transferred from ratchet teeth 142 of lock ring segments 140 may be applied against the ratchet teeth 436 of arcuate inserts 430.

While exemplary embodiments have been shown and described, modifications thereof can be made by one skilled in the art without departing from the scope or teachings herein. The embodiments described herein are exemplary only and are not limiting. Many variations and modifications of the systems, apparatus, and processes described herein are possible and are within the scope of the disclosure presented herein. For example, the relative dimensions of various parts, the materials from which the various parts are made, and other parameters can be varied. Accordingly, the scope of protection is not limited to the embodiments described herein, but is only limited by the claims that follow, the scope of which shall include all equivalents of the subject matter of the claims. Unless expressly stated otherwise, the steps in a method claim may be performed in any order. The recitation of identifiers such as (a), (b), (c) or (1), (2), (3) before steps in a method claim are not intended to and do not specify a particular order to the steps, but rather are used to simplify subsequent reference to such steps.

What is claimed is:

1. A plug for sealing a wellbore, comprising:

a slip assembly comprising a plurality of arcuate slip segments;

a nose cone coupled to the slip assembly and comprising a first end and a second end opposite the first end; and a packer comprising a first position configured to permit fluid flow across the plug when the plug is received in the wellbore, and a second position configured to seal the wellbore when the plug is positioned in the wellbore;

wherein one of the slip assembly and the nose cone comprises a plurality of circumferentially spaced pockets;

wherein the other of the slip assembly and the nose cone which does not comprise the pockets comprises a plurality of circumferentially spaced protrusions configured to be received in the pockets, and wherein each of the plurality of protrusions is defined by an outer face that extends orthogonally a central axis of the plug;

wherein the protrusions are received in the pockets to restrict relative rotation between the slip assembly and the nose cone when the packer is in the second position.

2. The plug of claim 1, wherein:

the slip assembly comprises the pockets, at least one pocket extending into an inner surface of each slip segment of the slip assembly; and the nose cone comprises the protrusions, the protrusions extending from the first end of the nose cone.

3. The plug of claim 1, further comprising:

a mandrel comprising a central passage, wherein the packer is disposed about the mandrel;

wherein one of the mandrel and the nose cone comprise an arcuate recess;

wherein the other of the mandrel and the nose cone which does not comprise the arcuate recess comprises an arcuate protrusion.

4. The plug of claim 3, wherein:

the mandrel comprises the arcuate recess, the arcuate recess extending into an end of the mandrel; and the nose cone comprises the arcuate protrusion, the arcuate protrusion extending from the second end of the nose cone.

5. The plug of claim 3, further comprising:

an engagement disk disposed about the mandrel;

a first clamping member disposed about the mandrel;

wherein at least one of the engagement disk and the first clamping member comprises a recess and wherein at least one of the engagement disk and first clamping member comprises a protrusion configured to be received in the recess to restrict relative rotation between the engagement disk and the first clamping member.

6. The plug of claim 5, wherein:

the engagement disk comprises the protrusion, the protrusion extending from an end of the engagement disk; and the first clamping member comprises the recess, the recess extending into an end of the first clamping member;

wherein the protrusion of the engagement disk and the recess of the first clamping member are each hexagonal.

7. The plug of claim 5, further comprising:

a second clamping member disposed about the mandrel, wherein the first and second clamping members each apply a compressive force to the packer in response to the plug being actuated from a first position to a second position;

wherein the second clamping member comprises an outer surface including a plurality of circumferentially spaced planar surfaces;

wherein each slip segment of the slip assembly comprises a planar inner surface in engagement with one of the planar surfaces of the second clamping member.

8. The plug of claim 3, wherein:

the mandrel comprises a first end, a second end opposite the first end, and an outer surface extending between the first end and the second end;

the outer surface of the mandrel comprises a plurality of circumferentially spaced recesses; and a plurality of arcuate inserts are received in the plurality of circumferentially spaced recesses of the mandrel.

9. A plug for sealing a wellbore, comprising:

a mandrel comprising a central passage;

a packer disposed about the mandrel, the packer configured to seal the wellbore in response to the plug being actuated from a first position to a second position; and a nose cone coupled to the mandrel, wherein the nose cone comprises an inner surface including a molded protrusion extending therefrom, wherein the molded protrusion is located on an axially extending portion of the inner surface that extends entirely about a central axis of the plug, wherein the molded portion is configured to prevent a spherical ball from sealing against the inner surface of the nose cone.

10. The plug of claim 9, wherein the nose cone is molded from a nonmetallic material.

11. The plug of claim 9, further comprising:

an engagement disk disposed about the mandrel and comprising a protrusion extending from an end of the engagement disk;

a first clamping member disposed about the mandrel and comprising a recess extending into an end thereof, wherein the recess is configured to receive the protrusion of the engagement disk to restrict relative rotation between the engagement disk and the first clamping member.

12. The plug of claim 9, wherein both the engagement disk and the first clamping member are molded from a nonmetallic material.

13. A plug for sealing a wellbore, comprising:

a mandrel comprising a central passage;

a packer disposed about the mandrel, the packer configured to seal the wellbore in response to the plug being actuated from a first position to a second position; and a nose cone coupled to the mandrel and comprising a body comprised of a first material, wherein the nose cone comprises an outer surface including an annular fin also comprised of the first material and extending continuously about an entire circumference of the nose cone and which is configured to provide a turbulent fluid flow in response to a fluid flow in the wellbore flowing around the plug.

14. The plug of claim 13, wherein the fin is configured to increase the surface area of the outer surface of the nose cone.

15. The plug of claim 13, further comprising:

an engagement disk disposed about the mandrel and comprising a protrusion extending from an end of the engagement disk;

a first clamping member disposed about the mandrel and comprising a recess extending into an end thereof, wherein the recess is configured to receive the protrusion of the engagement disk to restrict relative rotation between the engagement disk and the first clamping member.

16. The plug of claim 15, further comprising:

a second clamping member disposed about the mandrel, wherein the first and second clamping members each apply a compressive force to the packer in response to the plug being actuated from a first position to a second position;

a slip assembly disposed about the mandrel and comprising a plurality of arcuate slip segments, wherein the slip segments are configured to affix the plug to a string disposed in the wellbore.

17. The plug of claim 13, wherein the annular fin is monolithically formed with the body of the nose cone.

18. A plug for sealing a wellbore, comprising:

a mandrel comprising an outer surface including a plurality of ratchet teeth; and a body lock ring assembly comprising a plurality of arcuate lock ring segments, wherein an inner surface of each lock ring segment comprises a plurality of ratchet teeth configured to matingly engage the ratchet teeth of the mandrel;

wherein the mandrel comprises a body to which the plurality of ratchet teeth of the mandrel are coupled, and wherein the body comprises a first material having a shear strength that is less than a shear strength of a second material of which the plurality of ratchet teeth is comprised;

wherein the body lock ring is configured to lock the plug in sealing engagement with an inner surface of a tubular member disposed in the wellbore.

19. The plug of claim 18, further comprising a packer disposed about the mandrel; and a first clamping member disposed about the mandrel and configured to apply a clamping force against the packer;

wherein each arcuate lock ring segment comprises a frustoconical outer surface configured to engage a frustoconical inner surface of the first clamping member.

20. The plug of claim 18, further comprising an annular lock ring retainer, wherein the lock ring retainer is received in a groove formed in each of the arcuate lock ring segments.

21. The plug of claim 18, wherein:

the outer surface of the mandrel comprises a plurality of circumferentially spaced recesses formed in the body of the mandrel;

a plurality of arcuate inserts are received in the plurality of circumferentially spaced recesses of the mandrel, and wherein each arcuate insert comprises an outer surface including the plurality of ratchet teeth of the mandrel configured to matingly engage the ratchet teeth of the arcuate ring segments of the body lock ring; and the plurality of arcuate inserts each comprises the second material having a second shear strength.

* * * * *